United States Patent [19]

Lair et al.

[11] Patent Number: 4,712,575

[45] Date of Patent: Dec. 15, 1987

[54] SELF-DRAINING HOSE CONNECTION VACUUM BREAKER AND BACKFLOW PREVENTER

[75] Inventors: John E. Lair; Lawrence F. Luckenbill; Richard J. Holliday, all of Decatur, Ill.

[73] Assignee: A. W. Cash Valve Manufacturing Corporation, Decatur, Ill.

[21] Appl. No.: 20,566

[22] Filed: Mar. 2, 1987

[51] Int. Cl.[4] ..... F16K 24/00

[52] U.S. Cl. ..... 137/218; 137/798

[58] Field of Search ..... 137/218, 798; 251/149.4

[56] References Cited

U.S. PATENT DOCUMENTS

| | | | |
|---|---|---|---|
| 2,893,418 | 7/1959 | Leventhal | 137/218 |
| 2,997,054 | 8/1961 | Woodford | 137/218 |
| 3,083,723 | 4/1963 | Duchin | 137/218 |
| 3,670,760 | 6/1972 | Butcher et al. | 137/218 |
| 4,475,570 | 10/1984 | Pike et al. | 137/218 |
| 4,669,497 | 6/1987 | Tenhengel | 137/218 |

OTHER PUBLICATIONS

Literature Sheet of A. W. Cash Valve Mfg. Corp. published May 1, 1979.

*Primary Examiner*—Gerald A. Michalsky

*Attorney, Agent, or Firm*—Wood, Dalton, Phillips, Mason & Rowe

[57] ABSTRACT

A self-draining hose connection vacuum breaker and backflow preventer having a flexible annular diaphragm and a coacting seat disc movable relative thereto which, together, function to prevent backflow through the device and with the annular diaphragm coacting with atmospheric vents to provide a vacuum break and fluid drain. A movable piston has two different positions, dependent upon whether or not a hose is connected to the device, with the piston mounting the seat disc for movement therewith and relative thereto whereby the seat disc and annular diaphragm coact to prevent backflow when a hose is attached to the device, but the seat disc is positioned to permit flow through a central opening of the annular diaphragm when a hose is removed from the device to prevent trapped water in a source valve, such as a faucet or the like, which could result in either pipe and/or valve rupture resulting from freezing or retention of stagnant water which could result in bacterial growth.

22 Claims, 7 Drawing Figures

FIG. 1
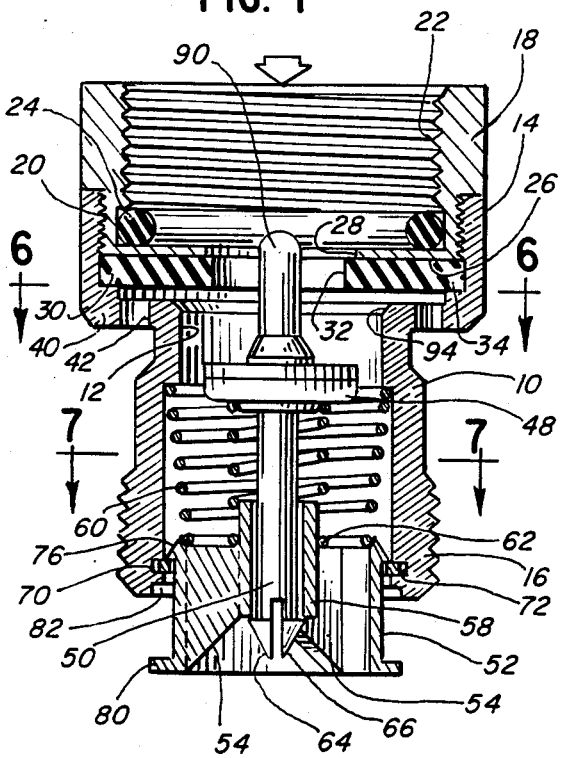
FIG. 2
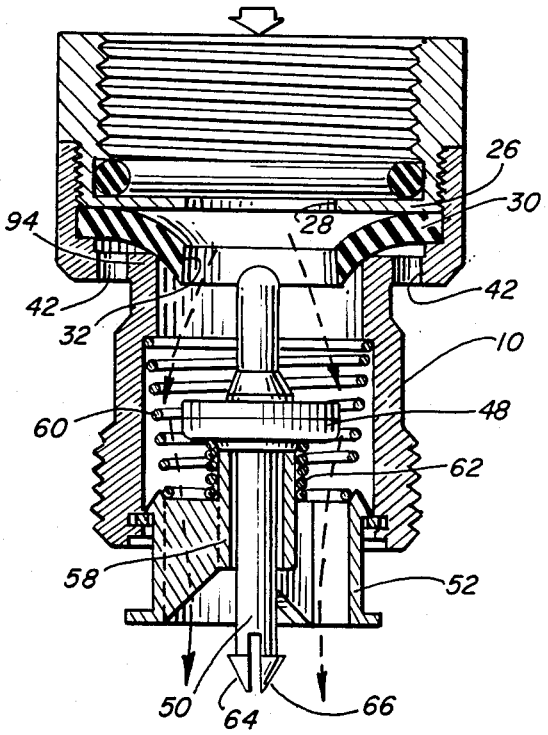
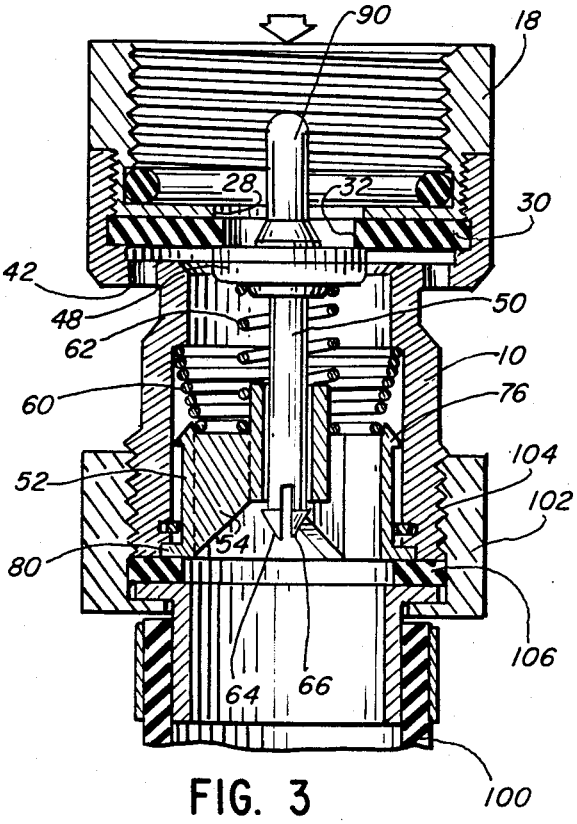
FIG. 3
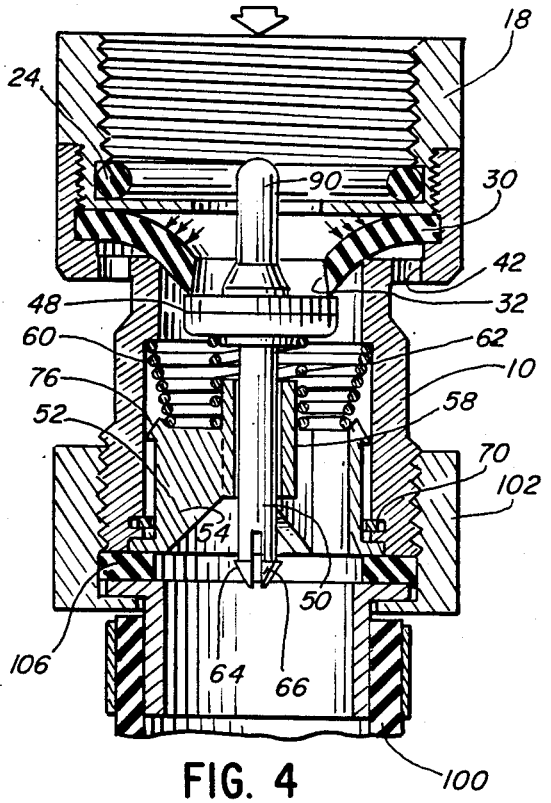
FIG. 4

FIG. 5
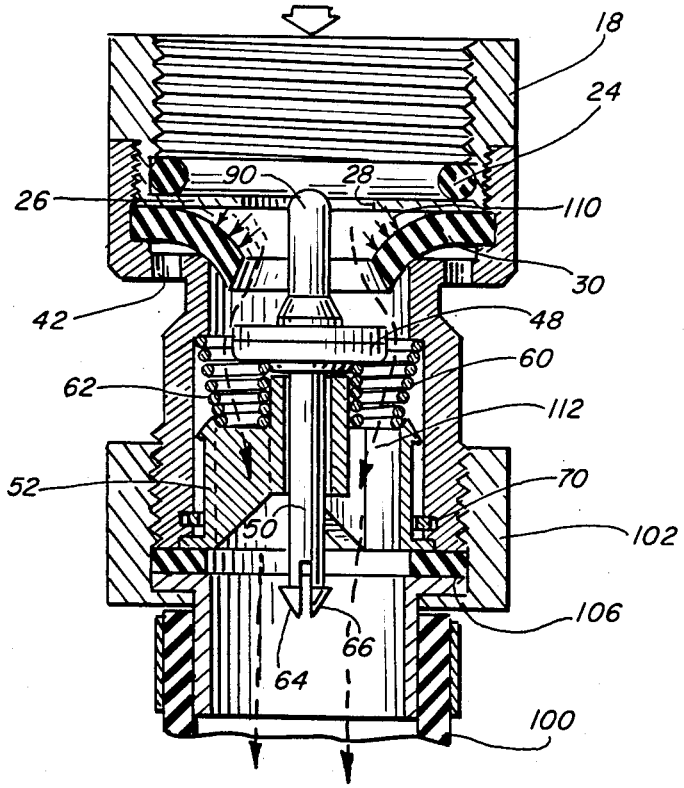
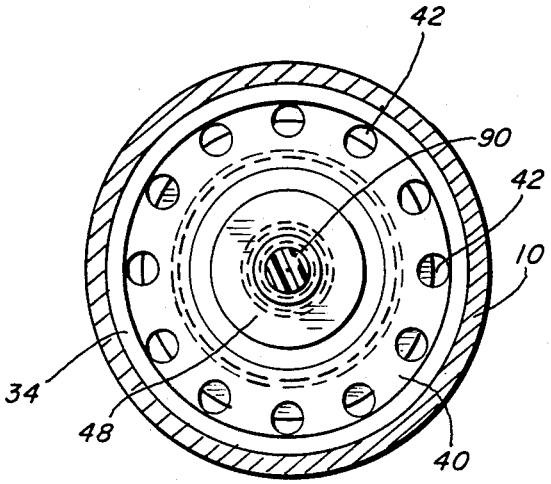
FIG. 6
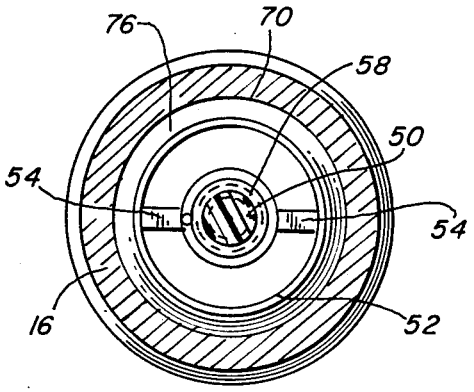
FIG. 7

SELF-DRAINING HOSE CONNECTION VACUUM BREAKER AND BACKFLOW PREVENTER

BACKGROUND OF THE INVENTION

1. Technical Field

This invention relates to an improvement in a hose connection vacuum breaker and backflow preventer which is attachable to the hose connection of a faucet or the like and, more particularly, to such a device which is self-draining to provide automatic draining of a faucet, hydrant, or sillcock to which the device is attached when a separate or integral connection for a hose or other liquid conductor is detached from the device.

A hose connection vacuum breaker and backflow preventer is operable to permit normal fluid flow to a hose or the like when a faucet is open and to prevent reverse flow back to the supply. In addition to preventing backflow, atmospheric vents are effective to break any vacuum.

2. Background Art

The assignee of this application markets devices of the hose bibb type. A device can be permanently attachable to the hose connection of a fluid source, such as a faucet, hydrant or sillcock and a hose connector may be connected to it. One such device has a tubular body with atmospheric vent holes and a flexible annular diaphragm normally urged to a position to prevent backflow and to be in nonobstructing relation with the atmospheric vent holes. When there is fluid flow from the source, the diaphragm is deflected from its seated position to close the atmospheric vent holes and permit flow through the device. When the supply is cut off, as by closing the faucet, the diaphragm is spring-urged by suitable means to its closed, seated position to prevent backflow and move out of obstructing relation with the atmospheric vent holes.

A backflow preventer and vacuum breaker of the hose bibb type is shown in Butcher et al. U.S. Pat. No. 3,670,760, owned by the assignee of this application.

Another type of device has drain openings and an external ring for closing the drain openings and which can be moved to a position to permit flow through the drain openings.

The prior devices have had to be manually actuated to achieve draining when the hose connector is detached. Failure to drain the faucet, hydrant or sillcock, especially freeze-proof sill cocks could result in freezing of the trapped water and consequent piping and/or valve rupture or retention of stagnant water. Considerable property damage may result in the case of freezing of the trapped water and resulting pipe rupture. If stagnant water is trapped, resulting bacterial growth may cause contamination.

The device shown in the Butcher et al. patent has a manually engageable member associated with the diaphragm to flex the diaphragm away from its closed, seated position whereby water may drain through the device.

The automatic draining of a faucet, hydrant or sillcock when an integral or separate connector for a hose or the like is removed from the hose connection vacuum breaker and backflow preventer is a distinct improvement over the prior art.

DISCLOSURE OF THE INVENTION

A primary feature of the invention is to provide a hose connection vacuum breaker and backflow preventer which is self-draining in response to removal of a hose therefrom and which requires no further action or effort to achieve this result after the hose is removed.

In the foregoing paragraph and other paragraphs of this Disclosure of the Invention as well as in the Disclosure of the Preferred Embodiment, reference is made to a hose being either connected, removed (or not connected to the device.) It should be understood that such reference is made for purposes of brevity and that such reference contemplates the use of a connector which is either integral with or separate from a hose or other liquid conductor and which is connected or not connected to the device.

Additional features of the invention reside in the construction thereof to enable components thereof to be permanently associated with each other by "snap-together" assembly without requiring any special tools or machines; component design to minimize flow loss through the device; and structure to break the surface tension of the fluid within the device to allow fluid from a supply to drain therethrough.

An object of the invention is to provide a self-draining hose connection vacuum breaker and backflow preventer which will automatically drain a faucet, hydrant, sillcock or other fluid fitting when a hose is removed from the device.

Another object of the invention is to provide a self-draining hose connection vacuum breaker and backflow preventer having a tubular body with an internal passage, an annular diaphragm mounted in said internal passage, a movable seat disc movable between a position sealing a central opening in the diaphragm and a position remote from the diaphragm, and means responsive to the absence or presence of a hose attached thereto for controlling the position of the seat disc and operable to have the seat disc spaced from the annular diaphragm when a hose is not attached to the device.

Another object of the invention is to provide a self-draining hose connection vacuum breaker and backflow preventer, as defined in the preceding paragraph, wherein said means responsive to the presence or absence of a hose includes a piston movably mounted in the tubular body of the device and which movably mounts a post having the seat disc thereon. The piston has a position extended outwardly of the tubular body when a hose is not attached to the device and is movable inwardly thereof when a hose is attached to move the seat disc into engagement with the diaphragm. The seat disc is yieldably urged against the diaphragm and can move away therefrom when there is flow through the device from a fluid supply.

Still another object of the invention is to provide a self-draining hose connection vacuum breaker and backflow preventer, as defined in the preceding paragraphs, wherein the post and piston can be assembled together, along with associated spring components, by a "snap-together" assembly not requiring any special tools or machines and the piston can be assembled to the tubular body by means of a split retaining ring or expandable elastomeric O-ring which retains the piston within the tubular body and seals against fluid flow between the piston and the tubular body.

A further object of the invention is to provide a self-draining hose connection vacuum breaker and backflow preventer, as defined in the preceding paragraphs, wherein the components thereof are constructed and assembled to provide substantially straight-through, open fluid flow from the inlet to the outlet of the device.

The foregoing and other objects, features and advantages of the present invention will become more readily apparent to those skilled in the art from the embodiment thereof shown in the accompanying drawings, and from the description thereof. It is to be understood, however, that such embodiment is shown by way of illustration only, to make the principles and practice of the invention more readily comprehensible, and without intent of limiting the invention to the specific details therein shown.

BRIEF DESCRIPTION OF THE DRAWINGS

FIG. 1 is a central, vertical section of the self-draining hose connection vacuum breaker and backflow preventer without a hose connected thereto and shown in the drain condition;

FIG. 2 is a view, similar to FIG. 1, with a hose not connected thereto and showing flow through the device as indicated by the arrows;

FIG. 3 is a view, similar to FIG. 1, with a hose connected thereto, without any pressure existing at the inlet end and without any flow therethrough;

FIG. 4 is a view, similar to FIG. 1, with a hose connected thereto, with the existence of fluid pressure at the inlet end and without any flow therethrough;

FIG. 5 is a view, similar to FIG. 1, with a hose connected thereto, and with the parts positioned with fluid flowing there through under pressure;

FIG. 6 is a transverse section, taken generally along the line 6—6 in FIG. 1; and FIG. 7 is a transverse section, taken generally along the line 7—7 in FIG. 1.

DISCLOSURE OF THE PREFERRED EMBODIMENT

The self-draining hose connection vacuum breaker and backflow preventer has a tubular body 10 with an internal passage 12. The tubular body 10 has an internally-threaded inlet end 14 and an externally-threaded outlet end 16. A tubular member 18 constitutes an additional body member and is threadably connected at 20 to the inlet end 14 of the tubular body. The tubular member 18 has an internal thread 22 for attachment to a faucet, hydrant, or other fluid source, such as a sillcock, with means (not shown) for permanent attachment thereto. An O-ring 24 is fitted into a recess within the tubular member 18 to provide a fluid seal with the faucet or other fluid supply connection.

The tubular member 18 has an end wall 26 with a central opening 28. An annular diaphragm 30 with a central opening 32 is captured between the end wall 26 of the tubular member 18 and an annular shelf 34 formed in the tubular body 10. The annular diaphragm has a normal position, shown in FIG. 1, and can flex to a position, such as shown in FIGS. 2, 4 and 5, under certain conditions. The diaphragm can be formed of a relatively hard, but flexible, material, with an example thereof being given in the previously-referred to Butcher et al. patent. The central opening 32 in the annular diaphragm is in alignment with the central opening 28 in the end wall 26 of the tubular member 18.

The tubular body 10 is of two differing diameters, with a transition wall 40 having a plurality of atmospheric vents 42 spaced from the annular diaphragm 30 when the latter member is against the end wall 26. and which are effectively closed when the annular diaphragm is in the flexed position, shown in FIGS. 2, 4 and 5.

A movable seat disc 48 having a layer of material, such as an elastomer, on the surface thereof is movable between an active position in engagement with the annular diaphragm 30 to seal the central opening 32 thereof, as seen in FIG. 3, and an inactive position wherein the central opening 32 is not closed, and as seen in FIGS. 1, 2 and 5. The seat disc 48 is mounted on a post 50 which is movable with and relative to a hollow piston 52 which is movably mounted within the internal passage at the outlet end 16 of the tubular body. The hollow piston 52, as seen in FIG. 7, has two or more ribs 54 which join to define a tubular guide 58 for the post 50.

The self-draining hose connection vacuum breaker and backflow preventer which is of the bibb type is used in a generally vertical orientation, as shown in FIG. 1, when connected to a faucet or other source of fluid and the piston 52 will normally be in the position shown in FIGS. 1 and 2 when a hose is not connected to the device as a result of gravity. However, yieldable means may be associated with the piston to assure that the piston assumes this position and, as shown in the drawings, a slightly conical, coiled compression spring 60 is positioned between a shoulder of the tubular body 10 and an end of the piston 52 to yieldably urge the piston to the position shown in FIG. 1. A second coiled compression spring 62 is positioned between the seat disc 48 and the piston 52 and in surrounding relation with the post 50 to yieldably urge the seat disc 48 away from the piston 52 while permitting movement of the seat disc relative to the piston under certain conditions to be described.

The movement of the seat disc 48 away from the piston 52 is limited by engagement between structure at an end of the post 50 and an end of the tubular guide 58 of the piston and with the structure enabling a "snap-together" assembly of the post and piston. The post has a bifurcated end defining a pair of flexible members 64 and 66 which, together, define a pair of spaced-apart sections of a shape similar to an arrowhead and with a pair of shoulders whereby the post can be inserted into the piston by downward movement thereof, as viewed in the orientation of FIG. 1, with the flexible members being compressed to enable passage into and through the guide 58. After the flexible members reach the position shown in FIG. 1, they snap outwardly to have the shoulders in engagement with an end of the tubular guide 58 to retain the post and piston in assembled relation. As part of this assembly, it will be evident that the spring 62 is placed in operative position prior to this assembly step.

Additionally, the "snap-together" assembly without the use of special tools includes the assembly of the piston 52 and the spring 60. After assembly of the post 50 to the piston 52, as described in the preceding paragraph, the spring 60 is positioned within the internal passage and the piston then inserted into the internal passage from the lower end of the device, as viewed in FIG. 1. This assembly is accomplished by utilization of a retaining ring 70 loosely fitted within an internal annular recess 72 in the outlet end 16 of the tubular body. This retaining ring can be made of metal, plastic, or elastomeric material and is of a construction whereby it may expand slightly within the annular recess 72 when the piston 52 is inserted into the internal passage. The piston 52 has a peripheral cam and shoulder 76 at its upper end whereby, upon insertion of the piston, the peripheral cam cams the retaining ring 70 outwardly until the cam moves past the retaining ring and the retaining ring can then contract inwardly to engage behind the shoulder on the piston. The retaining ring functions to retain the piston 52 in association with the tubular body and to also seal against fluid flow around the exterior of the piston 52.

The lower end of the piston 52 has a peripheral flange 80 for coaction with a hose, in a manner to be described, and which can nest into an annular recess 82 at the lower end of the outlet end 16 of the tubular body when a hose is attached to the device and as seen in FIGS. 3–5.

A pintle 90 extends upwardly from the seat disc 48 and is fixed thereto and extends into the central opening 28 of the end wall 26 and the central opening 32 of the diaphragm 30 in certain positions of the seat disc 48, which are to be subsequently described.

Various modes of operation of the self-draining hose connection vacuum breaker and backflow preventer will now be described.

When a source valve (not shown), such as a faucet, is in the off condition and a hose is not connected thereto, there is no supply of fluid pressure or flow. Under these conditions, the spring 60 pushes the piston 52 downwardly, as seen in FIG. 1, to seat the piston shoulder against the retaining ring 70 to have the piston in a downward limit position. The spring 62, acting between the seat disc 48 and the piston 52, forces the post and seat disc 48 upwardly, away from the piston 52, until the shoulders on the flexible members at the end of the post, which define a limit stop, engage against the lower end of the tubular guide 58 on the piston. The pintle 90 projects into any fluid existing at the central openings of the end wall 26 and the annular diaphragm 30 if the source valve is filled with fluid to break the surface tension of the bubble and allow the supply fluid to drain through these openings and out of the device. In the case of a frostproof hydrant with below ground drain, the device acts as a vacuum breaker by means of the open atmospheric vents 42 to permit drainage of the hydrant riser through the drain port of the hydrant.

A second condition of operation is shown in FIG. 2 wherein a source valve (not shown) is opened to permit fluid flow through the device, but without any hose being connected thereto. In this condition, the piston 52 remains in its lower position. However, the annular diaphragm 30 senses a differential pressure between the inlet end and the atmospheric vents 42 and resultingly moving toward the atmospheric low pressure area. The annular diaphragm 30 is captured between the inlet end 14 of the tubular body and the tubular member 18 and is sealed around its periphery but can still flex to the position shown in FIG. 2 to seal against a seat 94 formed in the tubular body 10 to prevent fluid flow through the atmospheric vents 42.

The force of the supply fluid flow, with the flow being indicated by arrows in FIG. 2, causes the seat disc 48 and the post 50 to compress the spring 62 with the lower side of the seat disc seating against an end of the tubular guide 58 of the piston 52. With the parts positioned as shown in FIG. 2, there can be relatively unrestricted flow through the device and, together with the substantially straight-line flow therethrough, there is minimal flow loss. The flow is through the central opening of the end wall 26, the central opening 32 of the annular diaphragm 30, through the internal passage of the tubular body 10 and around the seat disc 48 and through the hollow piston 52 to either side of the ribs 54 and 56. The seating of the piston 52 against the retaining ring 70 substantially seals against flow around the exterior of the piston and, thus, reduces undesirable spray from between the piston and the tubular body 10.

Three other conditions of operation are shown in FIGS. 3 to 5 and in each of these three conditions a hose is connected to the device. As stated previously, the attachment can be of a connector which is either integral with or separate from a hose or other liquid connector. The connector is operable to shift the position of piston 52. As seen in FIG. 3, a hose 100 has an internally threaded rotatable fitting 102 which threads onto the external threads of the outlet end 16 of the tubular body as at 104, with the fitting having an annular gasket 106 to establish a fluid seal with the outlet end 16 of the tubular body and which also engages the flange 80 of the piston 52 to move the piston from a first, outwardly-extended position to a second position in which it is substantially fully positioned within the internal passage of the tubular body 10.

For FIG. 3, the conditions are that the hose 100 is connected to the device and that there is no supply fluid pressure or flow because of the source valve being in an off condition. As previously described, the attachment of a hose to the device causes the gasket 106 to be forced against the outlet end 16 of the tubular body and, in the process, urge the piston 52 inwardly to its second position to completely seal the connection of the hose to the device. The piston 52 constitutes actuating means and forcing of the piston 52 into the tubular body 10 results in moving the post 50 and the seat disc 48 toward the annular diaphragm 30 and into position to have the seat disc 48 seal against the diaphragm 30 to close the central opening 32 of the annular diaphragm. Any back pressure through the hose 100 into the device is dissipated through the atmospheric vents 42 and fluid is prevented from entering the supply fluid source by the seal between the seat disc 48 and the annular diaphragm 30. When a negative hose pressure condition exists, the atmospheric vents 42 act as a siphon break and permit draining of any residual fluid from the hose when the hose is discharged to atmosphere.

The condition of operation illustrated by FIG. 4 differs from that of FIG. 3 in that there is supply fluid pressure resulting from a source valve being open. However, the outlet end of the hose is closed so that there is no fluid flow. With supply fluid pressure as indicated by the arrows, and without flow, the annular diaphragm 30 moves toward atmospheric lower pressure to engage against a seat 94 and seal the atmospheric vents 42. The seat disc 48 moves downwardly against the urging of the spring 62, but continues to seal against the annular diaphragm 30 to close the central opening 32 thereof. Thus, backflow contamination is prevented.

Should the source valve be closed, the components of the device will remain as shown in FIG. 4 until pressure is relieved within the hose 100, whereupon the components of the device will return to the position shown in FIG. 3 with continued backflow prevention and with the atmospheric vents open.

The condition illustrated by FIG. 5 differs from FIG. 4 in that the outlet end of the hose has been opened. The conditions existing in FIG. 5 are that the hose 100 is connected to the device, the outlet end of the hose is open, and the source valve is open, so that there is supply fluid pressure and fluid flow, with the pressure acting on the annular diaphragm 30 being indicated by the arrows 110 and the flow through the device being indicated by broken line arrows 112. As described in connection with FIG. 4, fluid pressure has caused flexure of the annular diaphragm 30 to seal the atmospheric vents 42. With fluid flow, the seat disc 48 and post 50 are urged downwardly, similarly as described in FIG. 2, against the force of spring 62 to open the central opening 32 of the annular diaphragm for substantially straight-line flow through the device. If the flow is stopped by restricting or closing the outlet end of the hose, the components of the device return to the condition illustrated in FIG. 4 with no leakage or loss of fluid. If the source valve for supply valve fluid is closed, and pressure is relieved in the hose 100, the components of the device return to the positions illustrated in FIG. 3 with little or no loss of fluid.

If the source valve for supply of fluid remains open, but supply fluid pressure drops below the pressure within the hose, the components of the device return to the condition illustrated in FIGS. 3 wherein the seat disc 48 seats against the annular diaphragm 30. The sealing of the seat disc against the annular diaphragm prevents backflow contamination. Also, the annular diaphragm 30 moves to its position against the end wall 26 and away from the seat 94 to open the atmospheric vents 42 to communicate the higher pressure in the hose to atmosphere and bleed off the fluid in the hose.

If the source valve for supply fluid is closed and the hose 100 drained and removed from the device, the components of the device return to the condition illustrated in FIG. 1. Any fluid remaining in the source valve, such as a faucet or sillcock, above the level of the device will self-drain through the device. This action occurs automatically upon removal of the hose and it is not necessary to take any steps, other than hose removal, to assure self-draining upon hose removal. For self-draining hydrants, the device in the condition illustrated in FIG. 1 functions to break siphon because of the atmospheric vents 42 and allows the hydrant to drain.

We claim:

1. A self-draining hose connection vacuum breaker and backflow preventer comprising, a tubular body having an internal passage with opposite inlet and outlet ends and atmospheric vent passages in a wall thereof, a flexible annular diaphragm in said body having a central opening and flexible under fluid pressure at the inlet to seal said atmospheric vent passages, a movable seat disc normally spaced from said control opening to permit fluid flow therethrough, and means movably mounted on said body and responsive to attachment of a hose to said body for yieldably urging said seat disc against the annular diaphragm to seal said central opening against reverse fluid flow from the outlet to the inlet.

2. A self-draining hose connection vacuum breaker and backflow preventer comprising, means defining a tubular body having an inlet end connectable to a valved source of fluid and an outlet end, means intermediate the ends of said tubular body defining atmospheric vents communicating the interior of said tubular body to the exterior thereof, an annular diaphragm with a central opening fitted in said tubular body between the inlet end and said atmospheric vent means and deflectable under fluid pressure at said inlet end to seal said atmospheric vents, a movable seat disc located between said annular diaphragm and the outlet end of the tubular body and of a size to close said central opening of the annular diaphragm, a movable piston having a first position extending outwardly of the outlet end of the tubular body, means mounting said seat disc for movement with and yielding movement relative to said movable piston with said seat disc being at a distance from the annular diaphragm when the movable piston is in said first position, said movable piston being of a shape and size to be engaged by a hose attached to said outlet end and be moved from said first position to a second position inwardly of the tubular body to seat the seat disc against the annular diaphragm.

3. A self-draining hose connection vacuum breaker and backflow preventer as defined in claim 2 including a post movably mounted on said piston and having said seat disc at an end thereof, and a pintle extended from said seat disc to extend through said central opening of said annular diaphragm.

4. A self-draining hose connection vacuum breaker and backflow preventer as defined in claim 3 including a spring urging the seat disc away from the piston, and coacting means on the post and piston limiting the travel of the seat disc away from the piston.

5. A self-draining hose connection vacuum breaker and backflow preventer as defined in claim 4 including a second spring urging the piston toward said first position.

6. A self-draining hose connection vacuum breaker and backflow preventer comprising, a tubular body having an inlet end connectable to a fluid source and an outlet end, means intermediate the ends of said tubular body defining at least one atmospheric vent communicating the interior of said tubular body to the exterior thereof, an annular diaphragm with a central opening fitted in said tubular body between the inlet end and said atmospheric vent and deflectable under fluid pressure at said inlet end to seal said atmospheric vent, a movable seat disc located between said annular diaphragm and the outlet end of the tubular body and of a size to close said central opening of the annular diaphragm, and actuator means having a first position extending outwardly of the outlet end of the tubular body and mounting said seat disc for movement therewith as well as for relative movement with said seat disc being at a distance from the annular diaphragm when the actuator means is in said first position, said actuator means being engageable by a hose attached to said outlet end to be moved from said first position to a second position inwardly of the tubular body to urge the seat disc against the annular diaphragm.

7. A self-draining hose connection vacuum breaker and backflow preventer as defined in claim 6 including a post movably mounted on said actuator means and having said seat disc at an end thereof, and a pintle extended from said seat disc to extend through said central opening of said annular diaphragm.

8. A self-draining hose connection vacuum breaker and backflow preventer as defined in claim 6 including a spring urging the seat disc toward said annular diaphragm, and means limiting the travel of the seat disc away from the piston.

9. A self-draining hose connection vacuum breaker and backflow preventer as defined in claim 8 including a second spring urging the actuator means toward said first position.

10. A self-draining hose connection vacuum breaker and backflow preventer comprising, a body with an internal passage having inlet and outlet ends, backflow prevention means in said passage including a diaphragm and a movable member with said movable member having an active position engaging the diaphragm and an inactive position spaced from said diaphragm, and means responsive to the attachment of a hose to said body for yieldably urging said movable member from the inactive position to the active position.

11. A self-draining hose connection vacuum breaker and backflow preventer as defined in claim 10 including means urging the movable member to the inactive position in the absence of a hose connected to the body.

12. A self-draining hose connection vacuum breaker and backflow preventer as defined in claim 10 including atmospheric vents in said body, and said diaphragm being shaped and mounted to close said atmospheric vents in response to pressure at said inlet end.

13. A self-draining hose connection vacuum breaker and backflow preventer as defined in claim 10 wherein said diaphragm has a central opening and said movable member is a seat disc of a size to close said opening when in said active position and can be moved away from said diaphragm in response to pressure at said inlet end.

14. A self-draining hose connection vacuum breaker and backflow preventer as defined in claim 13 wherein a pintle extends from said seat disc to extend into the central opening in said diaphragm.

15. A self-draining hose connection vacuum breaker and backflow preventer as defined in claim 10 including a hollow piston movable in said passage, means urging the piston outwardly of said body, said movable member being mounted on said piston, and said piston being shaped to be engaged by a hose to be moved inwardly thereby and bring the movable member to said active position.

16. A self-draining hose connection vacuum breaker and backflow preventer comprising, a tubular body with an internal passage, an annular diaphragm positioned in said internal passage, atmospheric vents in said tubular body adjacent said diaphragm, a hollow piston mounted in said internal passage at an outlet end thereof and having means defining a tubular guide, a post movably mounted in said tubular guide, and a seat disc on said post for coaction with said diaphragm, said post having a bifurcated end defining a pair of flexible members each having a shoulder whereby said members may be compressed to enable insertion of the post into the tubular guide with the members expanding to lock the post against removal from the tubular guide.

17. A self-draining hose connection vacuum breaker and backflow preventer comprising, a tubular body with an internal passage, an annular diaphragm positioned in said internal passage, atmospheric vents in said tubular body adjacent said diaphragm, a hollow piston mounted in said internal passage at an outlet end thereof and having means defining a tubular guide, a post movably mounted in said tubular guide, a seat disc on said post for coaction with said diaphragm, and an expandable ring movably mounted in said tubular body, said piston having an upper end with a peripheral cam and shoulder whereby the piston can be inserted into said tubular body by outward camming of the expandable ring and the piston is retained in the tubular body by coaction between the expandable ring and said shoulder.

18. A self-draining hose connection vacuum breaker and backflow preventer comprising, a tubular body with an internal passage and having an internally threaded inlet end and an externally threaded outlet end, a tubular end member threaded into said inlet end of said body and having an internal thread for attachment to a faucet or the like and an end wall with a central opening, an annular diaphragm positioned and captured between an annular shelf on said tubular body and said end member with a central opening of the diaphragm aligned with said central opening of the end wall, atmospheric vents in said tubular body adjacent said diaphragm, a hollow piston mounted in said internal passage at said outlet end and having internal ribs joined together to define a tubular guide, a post movably mounted in said tubular guide, a seat disc on said post for coaction with said diaphragm, a pintle extending from said seat disc to lie within the central opening of the diaphragm, a first spring urging the piston outwardly of the tubular body, a second spring urging the seat disc away from the piston, and a retaining ring on said tubular body for retaining said piston with the body.

19. A self-draining hose connection vacuum breaker and backflow preventer as defined in claim 18 wherein said post has a bifurcated end defining a pair of flexible members each having a shoulder whereby said members may be compressed to enable insertion of the post into the tubular guide with the members expanding to lock the post against removal from the tubular guide.

20. A self-draining hose connection vacuum breaker and backflow preventer as defined in claim 18 wherein said retaining ring is an expandable ring and said piston has an upper end with a peripheral cam and shoulder whereby the piston can be inserted into said tubular body by outward camming of the retaining ring and the piston is retained in the tubular body by coaction between the retaining ring and said shoulder.

21. A self-draining hose connection vacuum breaker and backflow preventer comprising a tubular body having inlet and outlet ends with a connecting internal passage, a wall extending across said passage with at least one opening therein, a flexible annular diaphragm urged against said wall and having a central opening, and automatically operable means responsive to the presence or absence of a hose connected to said outlet end enabling draining of fluid when a hose is not connected to said outlet end.

22. A self-draining hose connection vacuum breaker and backflow preventer connectable to a faucet or the like comprising, normally open means closable for preventing backflow therethrough, means for preventing creation of a vacuum therein when said faucet is closed, and means operable by a hose attached to the preventer to close said normally open backflow prevention means.

* * * * *